United States Patent [19]

Spanel et al.

[11] 4,109,594

[45] Aug. 29, 1978

[54] TUFTING MACHINE MALFUNCTION DETECTION DEVICE

[75] Inventors: Abram N. Spanel, 344 Stockton St., Princeton, N.J. 08540; P. Frank Eiland, Stamford, Conn.; David R. Jacobs, New Canaan, Conn.; Geza C. Ziegler, Stamford, Conn.

[73] Assignee: Abram N. Spanel, Princeton, N.J.

[21] Appl. No.: 811,968

[22] Filed: Jun. 30, 1977

[51] Int. Cl.[2] ..... D05C 15/16

[52] U.S. Cl. ..... 112/79 R; 112/273; 250/561

[58] Field of Search ..... 112/79 R, 79 A, 79 FF, 112/273, 278, 270, 78; 250/561

[56] References Cited

U.S. PATENT DOCUMENTS

| | | | |
|---|---|---|---|
| Re. 27,165 | 8/1971 | Spanel et al. | 112/79 R |
| 1,980,294 | 11/1934 | Ross et al. | 112/273 |
| 2,350,397 | 6/1944 | Haas | 112/273 |
| 3,174,046 | 3/1965 | Lindemann et al. | 112/273 |
| 3,728,296 | 6/1973 | MacKenzie et al. | 112/273 |
| 3,937,157 | 2/1976 | Spanel et al. | 112/79 FF |

FOREIGN PATENT DOCUMENTS

| | | | |
|---|---|---|---|
| 2,263,327 | 3/1975 | France | 112/273 |

*Primary Examiner*—H. Hampton Hunter
*Attorney, Agent, or Firm*—J. Rodman Steele, Jr.

[57] ABSTRACT

A tufting machine malfunction detection device comprising a laser detection system adapted to monitor for the existence of yarn within a chamber adjacent the needle station with detection indicating the presence of a malfunction.

19 Claims, 4 Drawing Figures

TUFTING MACHINE MALFUNCTION DETECTION DEVICE

BACKGROUND OF THE INVENTION

The subject invention has utility in various tufting systems, however, it has particular utility when used with the "Spanel tufting systems" which utilizes pneumatic transportation means for transporting yarn to the tufting stations.

The basics of the "Spanel tufting system" are disclosed in U.S. Pat. No. 3,554,147 which issued to Abram N. Spanel and George J. Brennan on Jan. 12, 1971 and U.S. Pat. No. Re 27,165 which issued Aug. 10, 1971 to Abram N. Spanel and Loy E. Barton. The aforementioned U.S. Pat. No. Re 27,165 discloses a pneumatic yarn transport system in which yarn is transported pneumatically to a tufting station where it is applied by tufting elements to a backing layer after being severed. Multicolor selection of the yarn bits is provided and for each needle station a choice of a number of colors is available.

The aforementioned U.S. Pat. No. 3,554,147 describes an alternative system to U.S. Pat. No. Re 27,165 and provides for the simultaneous selection of bit lengths of yarn of various colors for each tufting cycle at each individual tufting station. A collator structure is utilized in which individual channels transport yarn into a common passageway adjacent the tufting station. In the preferred embodiment, the severing function takes place in close proximity to the tufting station after a selected yarn strand has been fed into the common passageway.

As disclosed in co-pending patent application Ser. No. (S-168), an improved cutter mechanism is disclosed wherein yarn strands are transported to the tufting station and by means of reciprocating travelling knives which coact with a stationary blade, yarn is severed prior to tufting.

A tufting machine may have as many as 1200 individual tufting stations with each tufting station comprising a dual shank needle as described in U.S. Pat. No. Re 27,165. With yarn being fed to each of as many as 1200 needles, it is necessary that the yarn be correctly metered and that the cutter mechanism as described in co-pending patent application Ser. No. (S-168) be appropriately adjusted so that the yarn is severed at each needle station properly without failure. If the severing is not properly done, jamming and related malfunctions will occur. It is important that such malfunctions be detected immediately and the machine stopped to permit the defect to be corrected. Since yarn is comprised of many filaments and in view of the difficulties with severing a strand projected through a knife station but unattached at its downstream end, an extremely proficient cutter mechanism must be utilized. It is also equally important to detect malfunctions as they occur so that the machine may be immediately stopped and remedial action taken.

SUMMARY OF THE INVENTION

Accordingly, the subject invention is directed to a detection system which has been developed specifically for use with the Spanel-type multi-color pneumatic tufting machine and related types of machinery. The subject detection system comprises a source of light and receiving or register means to detect a malfunction in the yarn feeding and cutting operation of the multicolor pneumatic tufting machine.

As set forth in one embodiment of the Spanel tufting system, selected yarn strands are fed so as to extend to a loading position within a needle station at which point they are secured and severed to form yarn bits. The yarn bits are then tufted to clear the loading station of any yarn preparatory to the needles returning to a load position when the next yarn strands are selected and advanced pneumatically.

In conjunction with the subject invention, after the tufting occurs and before other yarn strands are advanced, the detection system is actuated so that any yarn remaining in the needle station chamber subsequent to the tufting will cause a signal that a malfunction is present.

It is necessary that the source of light has an extremely small beam and be adapted to the structural confines of the Spanel tufting apparatus and accordingly, a laser is most suitable for providing the light source.

BRIEF DESCRIPTION OF THE DRAWINGS

For a more detailed understanding of the invention, reference is made in the following description to the accompanying drawings in which.

DETAILED DESCRIPTION

Figure 1:
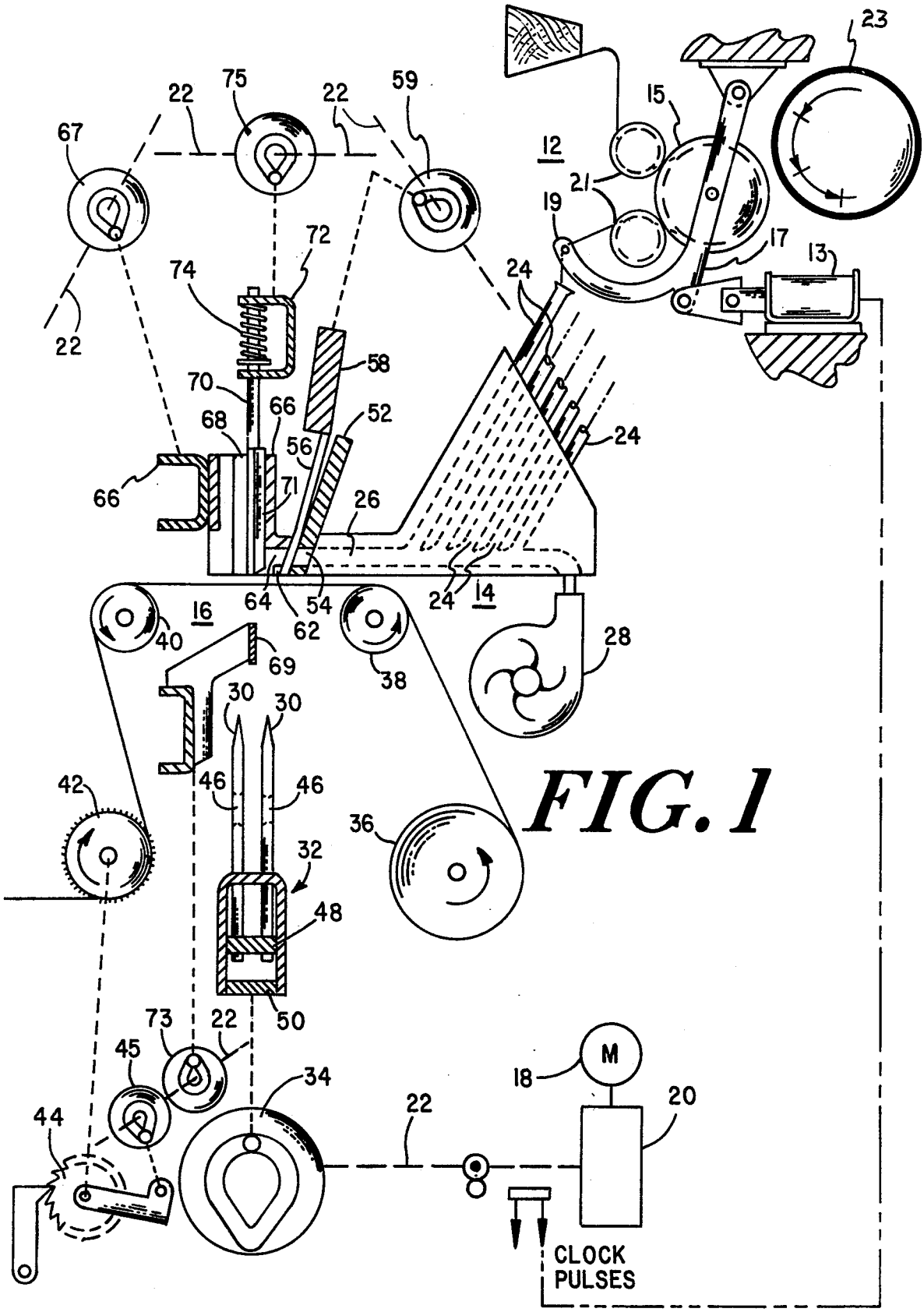
FIG. 1 discloses a schematic view of one embodiment of the tufting apparatus in which the subject laser detector may be utilized.

With reference to FIG. 1, tufting apparatus as disclosed herein includes yarn selection and metering apparatus 12, pneumatic transport apparatus 14, and a tufting station 16. Each tufting station 16 is representative of as many as 1200 such tufting stations and for each tufting station there will be available some five or eight yarn strands each representing a different color or some other variable.

Control signals for operation of each selection actuation means for each selection and metering apparatus may be provided by any of various readout devices. To produce a desired pattern on a backing layer, pattern information recorded on tapes, drums or other medium is converted into electrical or other types of signals which, at the proper time with regard to the machine tufting cycle, as indicated by the dashed clock pulses of FIG. 1, are transmitted to the actuation means 13 for the yarn selection and metering apparatus. The selection actuator 13 may be a solenoid or it may be any suitable one of a variety of electrical, thermal, pneumatic or hydraulic, etc. type actuators. For details of selection and metering in the Spanel tufting system aforementioned U.S. Pat. Nos. 3,554,147 and Re 27,165 should be consulted as well as 3,937,157 of which Abram N. Spanel and David R. Jacobs are inventors and co-pending application Ser. No. 699,904. A rotatable yarn feed mechanism 15 which may be on the order of that disclosed in U.S. Pat. No. 3,937,157 is shown in FIG. 1 together with intermediate linkage means 17 which extends from actuator 13 to rotatable yarn feed mechanism 15 and which also controls the yarn pull-back mechanism 19 fully described in U.S. Pat. No. 3,937,157. The yarn feed mechanism also includes yarn guides 21 and drive roll 23. The selection and metering system including yarn pull-back means of co-pending application Ser. No. 699,904 may be used as well as the rotatable yarn feed mechanism.

A motor 18 is shown driving the machine by means of drive transmission 20 which may be a train of gears or comprise other mechanisms. A shaft 22 is schematically shown running throughout the device from which drive mechanisms operate as will be described subsequently.

Briefly, specific color selection signals are generated in response to the color requirements of a desired pattern, and for each of the color selection signals transmitted to a selection actuation means 13, a predetermined length of selected yarn is metered by yarn selection and metering apparatus 12 and advanced by pneumatic transport apparatus 14 through yarn guide tubes 24 so that the selected yarn strand extends into a common passageway 26 leading to tufting station 16 where it will be cut and the resultant yarn bit tufted into backing layer L. A pneumatic source 28 schematically shown provides the pneumatic supply for pneumatic transport apparatus 14. Reference may once again be made to U.S. Pat. No. 3,937,157 or co-pending application Ser. No. 699,904 for suitable pneumatic systems. The pull back mechanism 19 which is part of the yarn selection and metering apparatus 12 will remove the last-selected yarn strand from the common passageway 26 adjacent the tufting station after severance of the yarn bit, preparatory to the next color selection by the control signals.

At the tufting station, tufting needles 30 with aligned eyes receive the yarn strands preparatory to tufting. The needles 30 are mounted on a needle bar 32 which via cam drive 34 provides reciprocable motion to the needles 30.

The backing L may be fed from a supply roll 36 over roller member 38. Idler roll 40 directs the tufted product to the take-up pin roll 42 which operates from the ratchet and pawl mechanism 44 functioning off cam drive 45.

Figure 2:
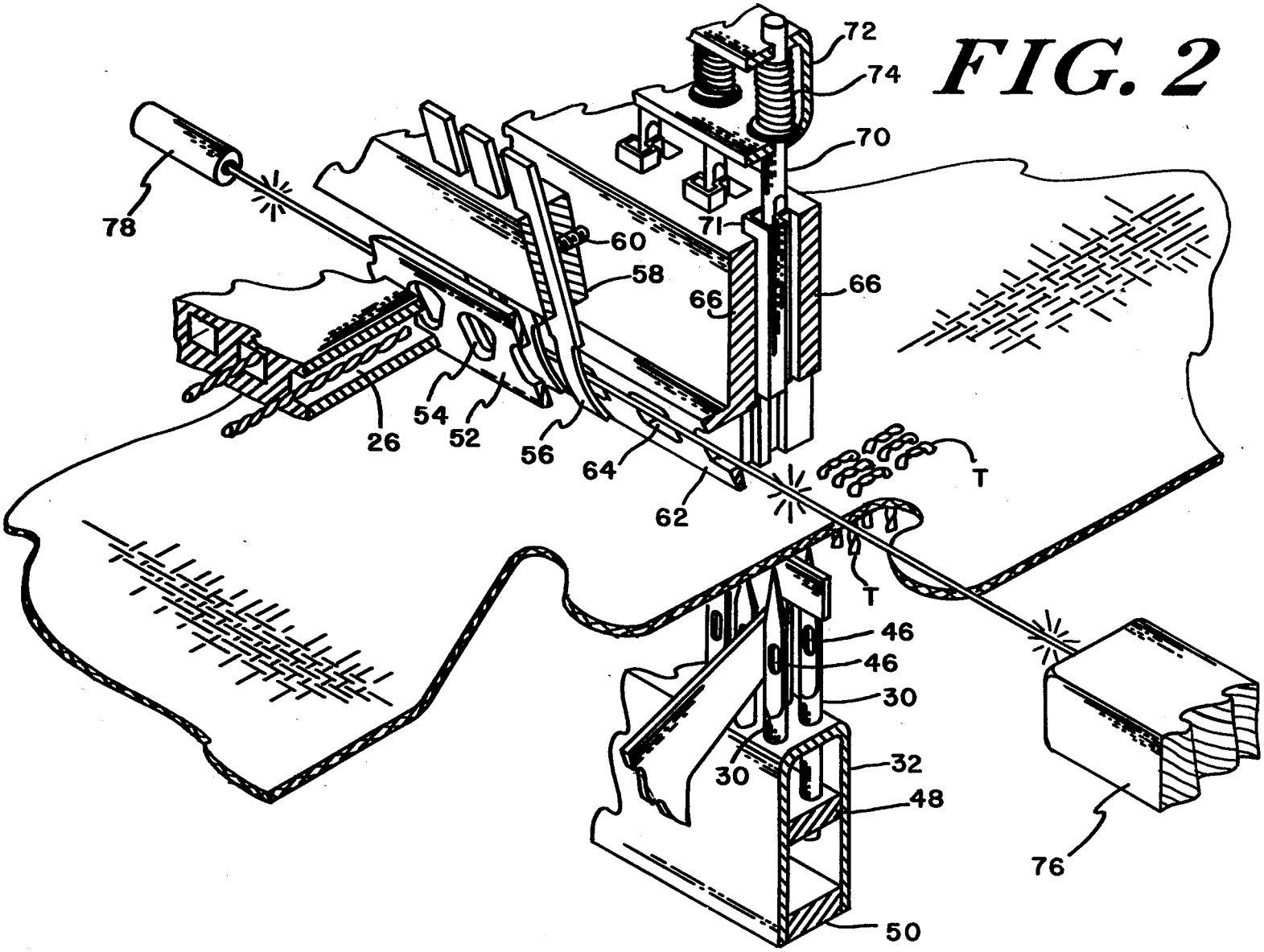
FIG. 2 is a perspective view showing a tufting station together with the laser detector.

With reference to FIG. 1 and FIG. 2, the tufting station 16 is shown comprising needles 30 which have aligned eyes 46. Each individual tufting station comprises dual needles 30 on the order of those disclosed in aforementioned Reissue Patent Re. 27,165. A needle bar 32 of lightweight construction aligns the needles 30 which are secured within the needle bar by needle bar insert member 48. A needle bar base plate 50 serves as mounting means for standard linkage structure which will drive the needle bar 32 by cam drive 34.

With further reference to FIGS. 1 and 2, a cutter mechanism stationary blade 52 having openings 54 is positioned adjacent common passageway 26 through which yarn extends toward each tufting station 16. Immediately adjacent the stationary blade 52, reciprocating blades 56 are positioned which are secured to reciprocating blade holder 58 which reciprocates in a widthwise direction with respect to the machine. This reciprocation is shown schematically as being provided by cam 59 in FIG. 1. Each individual reciprocating blade 56 is secured to reciprocating blade holder 58 by a locking and adjustment means 60 which may be on the order of a set screw device.

Adjacent the reciprocating blades, yarn adjuster 62 is shown having yarn openings 64 which align with the openings 54 of the stationary blade 52 to enable yarn strands to be pneumatically fed through to the tufting needles 30. The yarn adjustor 62 provides the tufting apparatus with the capability of selecting and tufting yarn of different lengths to produce rugs of different pile heights either on the same or different rugs. With reference to FIG. 2, U-shaped tufts are disclosed and it can be appreciated from FIGS. 1 and 2 that if different yarn lengths are metered by the yarn selection and metering apparatus 12 in the absence of some adjustment means, unequal tufts will result which will be of the nature of J-shaped rather than U-shaped since more or less yarn will be fed to the right of the needles 30 than the amount of yarn to the left of the needles 30 between the needles 30 and the cutting mechanism. Thus in constructing the apparatus disclosed herein, it is preferred to have the distance between the needles 30 and the reciprocating blade 56 be equal to the shortest tuftleg length that will be produced on the machine. If longer tufts are desired, the additional necessary yarn is advanced by the metering means 12 and pneumatically fed to the needles 30 with the additional yarn being fed to the right of the needles 30. The yarn adjuster 62 will then rise lifting the yarn and pulling back one half of the additional yarn to the left of the needles prior to severance by the reciprocating blade 56 so that each tuft-leg will be equal and U-shaped tufts will result. It will be appreciated that the above designations of right and left of the needles were directed to the view as shown in FIG. 2. The terms should be reversed when viewing FIG. 1.

Yarn adjuster carrier bar 66 is shown being an integral part of the yarn adjuster 62 and vertical reciprocation of the yarn adjuster carrrier bar 66 is enabled through linkage by eccentric member 67 schematically shown in FIG. 1.

Yarn bit clamps 70 are shown which clamp the yarn against the backing layer L prior to tufting by the needles 30 and before, during or after severance of the yarn. A shiftable support member 69 is provided opposite the backing layer L from the clamps 70 to provide support for the backing layer. The support member 69 is controlled by cam member 73 and is cleared from its support position as the backing layer L is advanced.

The yarn bit clamp 70 is shown having hollow shields 71 into which extend the needle 30 of each needle pair which is closest to the yarn adjuster 62. The shield serves to prevent impalement of the yarn by the shielded needle 30 as it descends in close proximity to the yarn adjuster 62.

The yarn adjuster carrier bar 66 is shown having channels 68 through which the bit clamps 70 are permitted to reciprocate as does yarn adjuster carrier bar 66 although independent of each other. The bit clamps 70 are secured to bit clamp carrier bar 72 which is shown housing spring means 74 supported by flange support 148 for each of the individual bit clamps 70. As shown in FIG. 1, cam 75 provides the vertical reciprocation for carrier bar 72.

A laser 76 is shown which will be positioned on one extreme side of the machine while a photo-detector 78 will be positioned at the opposite side of the laser aligned therewith so that the laser beam may be used to detect the presence of yarn in any of the channels at a time when such yarn should not be present. The presence of yarn at such a time indicates a malfunction.

Figure 3:
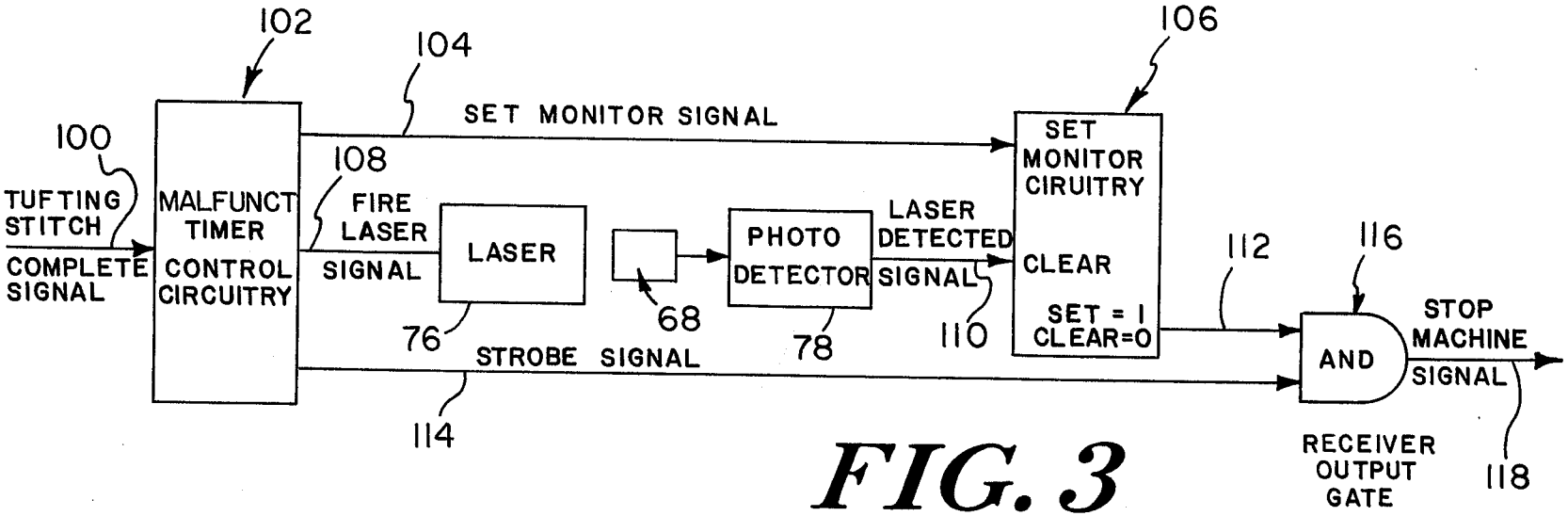
FIG. 3 is a diagram showing circuitry suitable for detecting and signalling a malfunction.

A particular circuit for utilizing a laser and photodetector for detection of tufting machine malfunctions in the area of the cutting operation is shown principally in block diagram form in FIG. 3. At the end of each tufting cycle, a Tufting Stitch Complete signal is received by the malfunction timer control circuitry 102 on line 100. The malfunction timer control circuitry 102 sequentially generates three output control signals, on lines 104, 108 and 114. The first signal generated by the malfunction timer control circuitry 102 is the Set Monitor signal which is received directly at the "Set" input of the monitor circuitry 106. The Set Monitor signal causes the output of the monitor circuitry, on line 112, to be in the positive or active state, often designated "1". This is designated in FIG. 3 as "Set = 1".

The second sequential output signal generated by the malfunction timer control circuitry is the Fire Laser signal, which activates laser 76. The light emitted from laser 76 will pass through channels 68, provided that no yarn bits are present at that time. If no yarn bits are present, the light emitted from laser 76 will be detected by photo-detector 78. If any yarn bits are blocking channel 68, then photo-detector 78 will not detect the light being emitted from laser 76. If photo-detector 78 does detect the light beam emitted from laser 76, then photo-detector 78 generates a Laser Detected signal on line 110 which is received at the "Clear" input of monitor circuitry 106. Reception of a Laser Detected signal by the monitor circuitry causes the output of the monitor circuitry on line 112 to be in the low or inactive state, often designated as "0". This is designated in FIG. 3 as "Clear = 0."

The third sequential signal generated by malfunction timer control circuitry 102 is Strobe signal, which is received directly at one input of monitor output AND gate 116. The other input of monitor output AND gate 116 is connected to line 112, the output of the monitor circuitry 106. The output of monitor output AND gate 116 is on line 118, on which a Stop Machine signal will be generated if a malfunction has been detected.

If line 112 is in the positive or active state when the Strobe signal is received, monitor output AND gate 116 will generate a Stop Machine signal. If output line 112 of monitor circuitry 106 is in the low or inactive state when the Strobe signal is received, then monitor output AND gate will not generate a Stop Machine signal, and the tufting process may continue.

In operation, the malfunction detecting apparatus is started when each set of tufting stitches has been completed. The malfunction timer control circuitry first generates a Set Monitor signal which causes the output of the monitor circuitry to be active. This presumes that there will be a malfunction. After the monitor circuitry output has been set, the malfunction timer control circuitry generates a Fire Laser signal, which activates the laser 76. If there are no yarn bits present in channel 68, photo-detector 78 will detect the light beam emitted from laser 76 and generate a Laser Detected signal which clears the output of monitor circuitry 106 to the inactive or zero state. When the malfunction timer control circuitry generates a Strobe signal, the path through monitor output AND gate 116 will be blocked by the low or inactive state of line 112 and the tufting process can continue. If yarn bits are present in channel 68, the photo-detector 78 will not detect the light beams emitted from laser 76 and the output of the monitor circuitry will remain high or active. When the malfunction timer control circuitry then generates the Strobe signal, it will not be blocked by the monitor output AND gate 116 and the Stop Machine signal will be generated on 118, causing the tufting process to be interrupted. This arrangement has the additional advantage of interrupting the tufting process not only when malfunctions are detected by the presence of yarn bits in channel 68, but also when either the laser or photo-detector malfunction as well.

It will be apparent to those skilled in the art that other control circuits utilizing signals of differing polarity and arrangement may be devised. In the control circuitry described above, the malfunction detection apparatus operates during a lag in otherwise continuous tufting operations. The control circuitry is adapted to interrupt this continuous process only when certain malfunctions have been detected. It is also possible, and may be desirable, to utilize a tufting process which is not continuous. In this mode of operation, the malfunction detecting apparatus by means of the monitor circuitry could generate two outputs. If no malfunctions are detected, the output would be a Continue Tufting signal which would initiate the next tufting operation. If a malfunction were detected, then a Malfunction signal would be generated, the Malfunction signal activating an appropriate alarm. The circuitry disclosed in FIG. 3 and described herein in detail is meant to provide one preferred embodiment for a laser control in accordance with the present invention, and is not intended to limit in any way the scope of applicants' invention.

Figure 4:
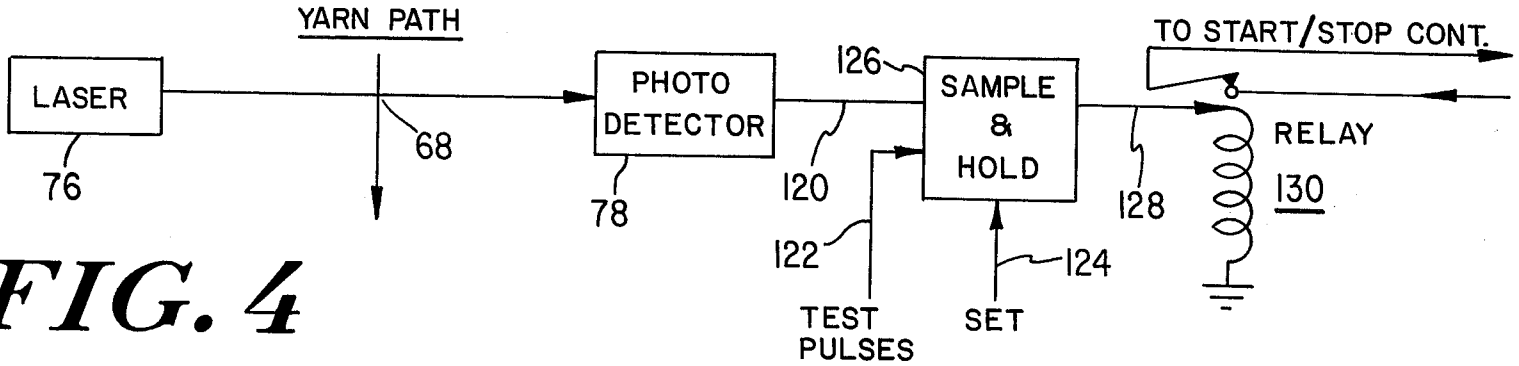
FIG. 4 is a diagram showing alternative circuitry suitable for detecting and signalling a malfunction.

Another laser control circuit is shown primarily in block diagram form in FIG. 4. In this embodiment, the laser 76 is of the type that may be fired continously. The photo-detector 78, which may be a phototransistor, is likewise continuously "looking" for the light beam emitted from the laser at all times. The output of the photo-detector 78 is fed to the input of Sample and Hold circuit 126 via line 120. Sample and Hold circuit 126 may be an integrated circuit flip/flop such as a D-type flip/flop. At the end of each tufting cycle, test pulses are applied via line 122 to Sample and Hold circuit 126. The effect of each test pulse is to cause the output line 128 of Sample and Hold 126 to be in the same state as line 120. Line 120 will be active or inactive depending on whether or not the light beam emitted by the laser has been received by photo-detector 78 or has been blocked by a yarn bit, indicating that malfunction has occurred. The polarity of this signal will depend on the particular circuit elements chosen, and is of no significance to the block circuit shown in FIG. 4.

When a malfunction has been detected, the output signal of Sample and Hold circuit 126 on line 128 will activate relay 130, which in turn generates a Stop Machine signal.

In order to restart the tufting machine after detection of a malfunction, a Set signal is delivered via line 124 to Sample and Hold circuit 126. The Set signal changes the output state of Sample and Hold circuit 126 on line 128 back to a no-malfunction condition, thereby causing relay 130 to generate a Start Machine signal. The Set signal may be generated by a push-button, not shown in the drawings. This circuit arrangement shares the advantage of the circuit shown in FIG. 3 in that the tufting process will be interrupted not only when malfunctions are detected by the presence of yarn bits in channel 68, but also when either the laser or photo-detector malfunction as well. The circuitry disclosed in FIG. 4, as that disclosed in FIG. 3, is meant to provide an alternative preferred embodiment for a laser control in accordance with the present invention and not intended to limit in any way the scope of applicants' invention.

Copending application Ser. Nos. (S-168), (S-171), (S-172), and (S-180) should be consulted for further description of the cutter mechanism 52, 56, yarn clamping means 70, 71, yarn adjuster 62 and needle bar 32.

The present invention may be embodied in other specific forms without departing from the spirit or essential attributes thereof, and accordingly, reference should be made to the appended claims, rather than to the foregoing specification as indicating the scope of the invention.

What is claimed is:

1. A method of tufting wherein the improvement comprises an improved method of detecting malfunctions, said method of tufting comprising the steps of:

pneumatically transporting yarn strands to a loading station with respect to yarn bit-applying elements;

severing said yarn strands to form yarn bits;

applying the yarn bits to a backing layer with said bit-applying elements; and, utilizing a light detection system within said loading station to detect the presence of yarn after the tufting cycle, which presence of yarn indicates a malfunction.

2. The method of claim 1 wherein said light detection system comprises:

a laser beam aimed toward said loading station; and, a photo-detector for receiving said beam.

3. The method of claim 2 wherein said light detection system further comprises:

a timer circuit for sequentially generating first, second and third control signals after said tufting cycle, said laser being activated in response to said second control signal;

a monitor circuit, set to a first output state in response to said first control signal and cleared to a second output state in response to detection of said beam, said first output state corresponding to a malfunction; and, an output gating circuit for enabling said third control signal as a malfunction indicating signal when said monitor circuit is in said first output state.

4. The method of claim 3 wherein said light detection system further comprises a second output gating circuit for enabling said third control signal as a no-malfunction indicating signal when said monitor circuit is in said second output state.

5. The method of claim 2 wherein said light detection system further comprises:

a circuit for sampling the output of said photo-detector; and relay means for stopping and starting said tufting process in response to a signal generated by said sampling circuit.

6. The method of claim 5, wherein said light detection system further comprises:

means for holding said sampled output; and means for resetting said sampling circuit after a malfunction has been detected.

7. A method of tufting wherein the improvement comprises utilizing an improved malfunction detection system comprising the steps of:

providing severed yarn bits in a loaded position with respect to bit-applying elements at tufting stations;

applying the severed yarn bits to a backing layer by said bit-applying elements during a tufting cycle;

searching by means of light source and receiver means for any yarn in the tufting stations after the tufting cycle is completed, the detection of such yarn indicating a machine malfunction; and signalling a malfunction when such yarn is detected.

8. The method of claim 7 wherein said light source means is a laser beam aimed toward said loading position and said receiver means is a photo-detector for receiving said beam.

9. The method of claim 8 wherein said searching comprises the steps of:

setting a monitor circuit to a first output state, said first output state corresponding to a malfunction, said monitor circuit having means for achieving a second output state in response to detection of said beams;

activating said laser; and, generating a control signal corresponding to the output state of said monitor circuit, said output state depending upon detection of said beams.

10. The method of claim 9 wherein a timing control circuit sequentially sets said monitor circuit, activates said laser and generates said control signal.

11. The method of claim 7 wherein said searching comprises the steps of:

continuously activating said light source;

sampling the output of said receiver means; and holding said output after each said tufting cycle.

12. The method of claim 11 wherein said signalling is accomplished by relay means activated in response to said held output signal.

13. Tufting apparatus or the like comprising:

a yarn source;

a yarn metering and feeding means;

a pneumatic yarn transport means;

yarn severing means; tufting elements to tuft yarn at a tufting station;

a yarn detection system including:

a source of light;

light receiving means; and signalling means whereby when after yarn is tufted, said yarn detection system is utilized to detect the presence of yarn in the tufting station, such presence indicating a malfunction which is signalled by said signalling means.

14. The tufting apparatus of claim 13 wherein said light source is a laser beam aimed toward said tufting station and said light receiving means is a photo-detector.

15. The tufting apparatus of claim 14, wherein said yarn detection system further comprises:

a timer circuit for sequentially generating first, second and third control signals after said yarn is tufted, said laser being activated in response to said second control signal;

a monitor circuit, set to a second output state in response to detection of said light, said first output state corresponding to detection of said yarn; and, an output gating circuit for enabling said third control signal as said now function presence signal when said monitor circuit is in said first output state.

16. The tufting apparatus of claim 15 wherein said yarn detection system further comprises a second output gating circuit for enabling said third control signal as a no-malfunction indicator when said monitor circuit is in said second output state.

17. The tufting apparatus or the like of claim 13, wherein said yarn detection system further comprises:

a circuit for sampling the output of said photo-detector; and relay means for stopping and starting said tufting process in response to a signal generated by said sampling circuit.

18. The method of claim 17, wherein said light detection system further comprises:

means for holding said sampled output; and means for resetting said sampling circuit after a malfunction has been detected.

19. The tufting apparatus or the like of claim 14, wherein said photo-detector is a photo-transistor.

* * * * *